US010316443B2

(12) United States Patent
Broughton, Jr. et al.

(10) Patent No.: US 10,316,443 B2
(45) Date of Patent: Jun. 11, 2019

(54) COMPOSITE BRAIDED OPEN STRUCTURE WITHOUT INTER-YARN BONDING, AND STRUCTURES MADE THEREFROM

(71) Applicant: AUBURN UNIVERSITY, Auburn, AL (US)

(72) Inventors: Royall M. Broughton, Jr., Auburn, AL (US); David G. Beale, Auburn, AL (US); David J. Branscomb, Statesville, NC (US); Austin R. Gurley, Auburn, AL (US)

(73) Assignee: AUBURN UNIVERSITY, Auburn, AL (US)

( * ) Notice: Subject to any disclaimer, the term of this patent is extended or adjusted under 35 U.S.C. 154(b) by 0 days.

(21) Appl. No.: 15/130,947

(22) Filed: Apr. 16, 2016

(65) Prior Publication Data

US 2016/0305052 A1 Oct. 20, 2016

Related U.S. Application Data

(60) Provisional application No. 62/148,831, filed on Apr. 17, 2015.

(51) Int. Cl.
*D04C 1/06* (2006.01)
*D04C 3/00* (2006.01)

(52) U.S. Cl.
CPC *D04C 1/06* (2013.01); *D04C 3/00* (2013.01)

(58) Field of Classification Search
CPC ..... D04C 3/00; D04C 1/06
USPC ..... 87/1
See application file for complete search history.

(56) References Cited

U.S. PATENT DOCUMENTS 3,025,861 A * 3/1962 Cobb, Jr. ..... A24D 3/04 131/200
4,051,659 A * 10/1977 Blakelock ..... D01F 9/14 523/215
4,500,595 A * 2/1985 Gerteisen ..... C08K 7/06 156/181
4,677,818 A * 7/1987 Honda ..... D07B 1/025 57/224
4,741,873 A * 5/1988 Fischer ..... B29B 11/14 156/148
4,847,063 A * 7/1989 Smith ..... C04B 35/83 156/148
4,873,142 A * 10/1989 Bach ..... D01F 6/18 428/359
5,016,516 A * 5/1991 Aldrich ..... B29C 33/485 428/367
5,307,615 A 5/1994 Walton et al.
(Continued)

*Primary Examiner* — Shaun R Hurley
*Assistant Examiner* — Bao-Thieu L Nguyen
(74) *Attorney, Agent, or Firm* — Tuggle Duggins P.A.; Blake Hurt

(57) ABSTRACT

A braided, open structure composite made with large prepreg tow can be cured without bonding at the yarn crossovers and after removal from the mandrel, it can be used directly as a spring in which the spring constant in bending, torsion, tension or compression can be controlled by the geometry of the braided structure as well as the size of the structural elements. Alternatively the spring may be curved in multiple directions to form complex shapes and then crossovers can be re-bonded to make more rigid open structure composites that would be difficult or impractical to manufacture by conventional techniques.

18 Claims, 5 Drawing Sheets

(56) References Cited

U.S. PATENT DOCUMENTS 5,470,920 A * 11/1995 Camberlin ..... C08G 73/121 525/419
5,662,855 A 9/1997 Liew et al.
5,899,134 A 5/1999 Klein et al.
5,908,049 A * 6/1999 Williams ..... E21B 17/206 138/125
5,913,337 A * 6/1999 Williams ..... E21B 17/206 138/125
6,245,423 B1 * 6/2001 Ikeda ..... D01F 6/18 264/206
6,260,807 B1 7/2001 Hoyt et al.
6,428,728 B1 * 8/2002 Sakai ..... B29B 9/14 264/171.13
6,508,910 B2 * 1/2003 Zhou ..... B29D 24/005 156/307.3
6,656,302 B2 * 12/2003 Kishi ..... B29B 15/122 156/162
6,731,497 B2 5/2004 Yokouchi et al.
6,740,381 B2 5/2004 Day et al.
7,132,027 B2 * 11/2006 Jensen ..... B29C 53/564 156/148
8,859,088 B2 10/2014 Broughton, Jr. et al.
2010/0181012 A1 * 7/2010 Hiel ..... B32B 15/04 156/180
2010/0323181 A1 12/2010 Nutt et al.
2011/0061519 A1 3/2011 Fields
2013/0291476 A1 * 11/2013 Broughton, Jr. ..... E04C 3/28 52/653.2
2013/0302604 A1 * 11/2013 Branscomb ..... D02G 3/44 428/365
2015/0044470 A1 * 2/2015 Tomioka ..... C08J 5/042 428/402
2015/0056449 A1 * 2/2015 Broughton, Jr. ..... E04C 3/28 428/376
2015/0101306 A1 * 4/2015 Schneiders ..... D07B 7/12 57/258
2015/0329315 A1 * 11/2015 Hatta ..... B65H 81/00 242/436
2016/0010246 A1 * 1/2016 Nakai ..... D02G 3/402 57/244
2016/0032082 A1 * 2/2016 Matsumoto ..... D06M 15/53 442/197
2016/0055936 A1 * 2/2016 Head ..... D04C 1/02 174/128.1
2016/0273138 A1 * 9/2016 Artzt ..... D04C 1/06

* cited by examiner

COMPOSITE BRAIDED OPEN STRUCTURE WITHOUT INTER-YARN BONDING, AND STRUCTURES MADE THEREFROM

This non-provisional patent application claims all benefits under 35 U.S.C. § 119(e) of U.S. provisional patent application Ser. No. 62/148,831 filed 17 Apr. 2015, entitled "COMPOSITE BRAIDED OPEN STRUCTURE WITHOUT INTER-YARN BONDING, AND STRUCTURES MADE THEREFROM", in the United States Patent and Trademark Office, which is incorporated by reference in its entirety herein.

FIELD OF THE INVENTION

The invention herein pertains to open architecture composites and particularly pertains to fiber-reinforced composites defining an open architecture or structure formed from large (i.e. high filament number) yarns that are pre-impregnated with an adhesive resin matrix and braided without bonded crossover points into the desired composite structure, such as a spring.

DESCRIPTION OF THE PRIOR ART AND OBJECTIVES OF THE INVENTION

Braided, lattice structure fiber-reinforced composites can form lightweight seamless truss structures but suffer from the inability to easily form complex shapes and the difficulty of extracting the mandrel for any shape other than those with parallel sides, or those which are conical/pyramidal to some degree. Historically, helical springs are produced from a single coil of torsionally stiff cylindrical elements twisted into a helical coiled shape. The spring structure defines spaces between the coils which either open or close with tension and compression, respectively. These coiled springs rely on the torsional stiffness of the element material for the overall compressional stiffness of the spring. Given the shear modulus of many materials is low compared to the axial stiffness, coil springs typically allow large travel (approx. 90% strain) but low overall stiffness for their weight. The use of braided, fiber-reinforced composite yarns to form structural members is known in the art (see for example, U.S. Pat. No. 8,859,088, entitled "Minimal Weight Composites Using Open Structure", U.S. Patent Publication No. 2013/0302604, entitled "Robust Pre-Impregnated Yarn for Manufacturing Textile Composites", and U.S. Patent Publication No. 2015/0056449, entitled "Minimal Weight Composites Using Open Structure", all belonging to the assignee/applicant of the subject application, the entire disclosures of which are all hereby incorporated by reference). It would be desirable to create a lightweight spring from lightweight composite materials and structures, but most structural composites have a shear modulus that is dependent on the matrix material (typically a polymer) and so cannot make springs of practical stiffness near the size of metal coil springs.

Conventional springs also rely on the material and the diameter of the cylindrical element to provide the torsional stiffness. Such springs "bottom out" (i.e. experiences a sudden and dramatic increase in stiffness) when compressed to the extent that successive helical coils of the spring come into contact (called the "solid height"). The typical helical spring further has very low bending stiffness due to the unsupported helix geometry; thus the spring must be constrained by another mechanism to ensure motion only in the axial direction, for example by restraining at least one of the spring ends, relying on standard spring end designs such as "squared" and "ground", utilizing special spring end anchoring members, enclosing the spring in a cylinder, or inserting a rod inside the substantial length of the spring for use as a cam follower. Because of these and other limitations, they cannot be made very long before buckling instability becomes a concern.

It has been discovered that a braided, open structure composite made from large (i.e. high filament number) yarns known as "tows" can be pre-impregnated with an adhering resin or substrate and cured without bonding at the yarn intersections (also known as "crossovers") and after removal from the mandrel, can be constructed and used as a spring in which the spring constant in bending, torsion, tension or compression can be controlled by the geometry of the braided structure as well as the size of the structural elements. Alternatively or additionally, the spring may be curved in multiple directions and then crossovers can be re-bonded to make more rigid open structure composites that would be difficult or impractical to manufacture by conventional techniques, particularly when considering the logistical difficulties of removing the same from a mandrel.

Thus, in view of the problems and disadvantages associated with prior art springs, the present invention was conceived and one of its objectives is to provide a braided, open architecture structure with unbound yarn crossover points sometimes referred to in the art as pics.

It is another objective of the present invention to provide an open architecture structure formed from large (i.e. high filament number) prepreg yarns without bonded crossover points.

It is still another objective of the present invention to provide an open architecture structure without bonded crossover points formed from yarns containing between fifty thousand and one hundred thousand (50,000-100,000) axially aligned carbon filaments.

It is yet another objective of the present invention to provide an open architecture structure without bonded crossover points formed from yarns defining a braid angle from fifty to one hundred degrees (50°-100°).

It is a further objective of the present invention to provide an open architecture structure without bonded crossover points formed from a material that produced significant travel comparable to conventional helical springs, preferably seventy-five percent (75%) reduction in unrestrained length for a compression-type spring.

It is still a further objective of the present invention to provide an open architecture structure without bonded crossover points formed on a conventional Maypole braiding machine and substantially liner mandrel.

It is yet a further objective of the present invention to provide an open architecture structure without bonded crossover points that defines both rigid and flexible sections.

It is another objective of the present invention to provide an open architecture structure without bonded crossover points that defines the same spring constant as a coiled spring, but with a much lighter weight.

It is still another objective of the present invention to provide a method of forming an open architecture structure without bonded crossover points.

It is yet a further objective of the present invention to provide a method of removing an open architecture structure without bonded crossover points from a conventional mandrel.

It is a further objective of the present invention to provide a method of forming tubular structures that are curved, bent, or otherwise arcuate over a longitudinal length before curing.

Various other objectives and advantages of the present invention will become apparent to those skilled in the art as a more detailed description is set forth below.

SUMMARY OF THE INVENTION

The aforesaid and other objectives are realized by producing an open structure composite member such as a spring, without bonded crossover points, on a conventional braiding machine. The open structure composite member has a higher strength and stiffness to weight ratio than composite structures made from resin coated fabric, solid filament wound composites, or from other typical spring-construction materials like metal. At least two sets of large pre-impregnated (i.e. prepreg) yarns are braided by a braiding machine, such as a Maypole braiding machine. The sets of yarns are oriented in the opposite pitch direction, and it should be understood that additional sets of yarns may be incorporated as desired. Additionally, or in the alternative, another set of yarns may be deployed in the axial direction to produce a structure with additional structural capabilities. The yarns are spaced widely (relative to the standard braiding configuration for structural members) on a cylindrical or polygonal tapered mandrel, defining an orientation best described as a tubular woven lattice. Precautions are taken to prevent bonding at the yarn crossover points. This produces a spring that is greater in flexibility than the prior art as it pertains to compression, tension, torsion, and bending metrics. The spring may then be conformed into any number of shapes that could not otherwise be manufactured on and removed from on a conventional rigid mandrel. To produce a more structurally rigid section or member, the crossover points may later be cured after the spring is removed from the mandrel surface.

DETAILED DESCRIPTION OF THE PREFERRED EMBODIMENT AND OPERATION OF THE INVENTION

Figure 1:
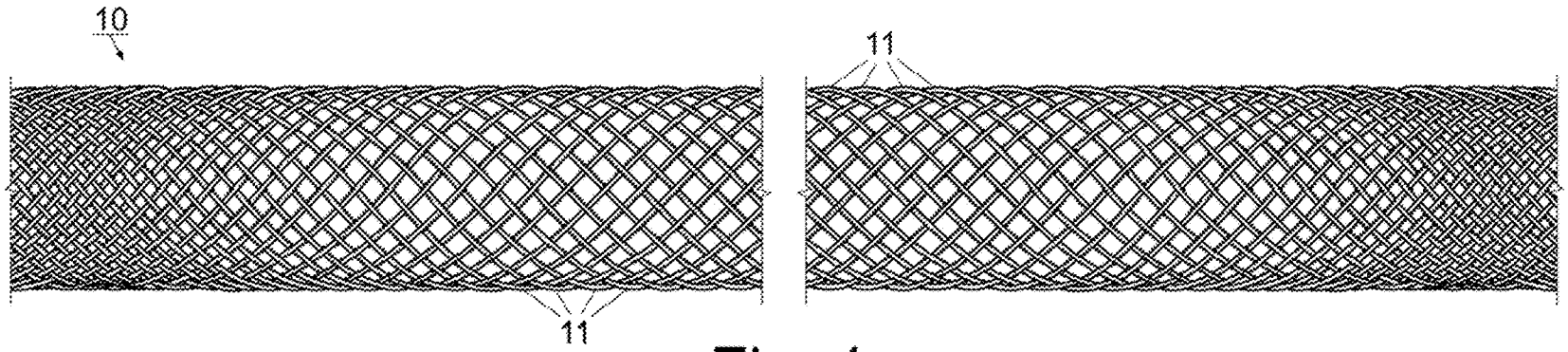
FIG. 1 shows an elevated plan view of an open architecture composite member, FIG. 2 pictures an elevated plan view of the member of FIG. 1 after longitudinal contortion.
Figure 2:
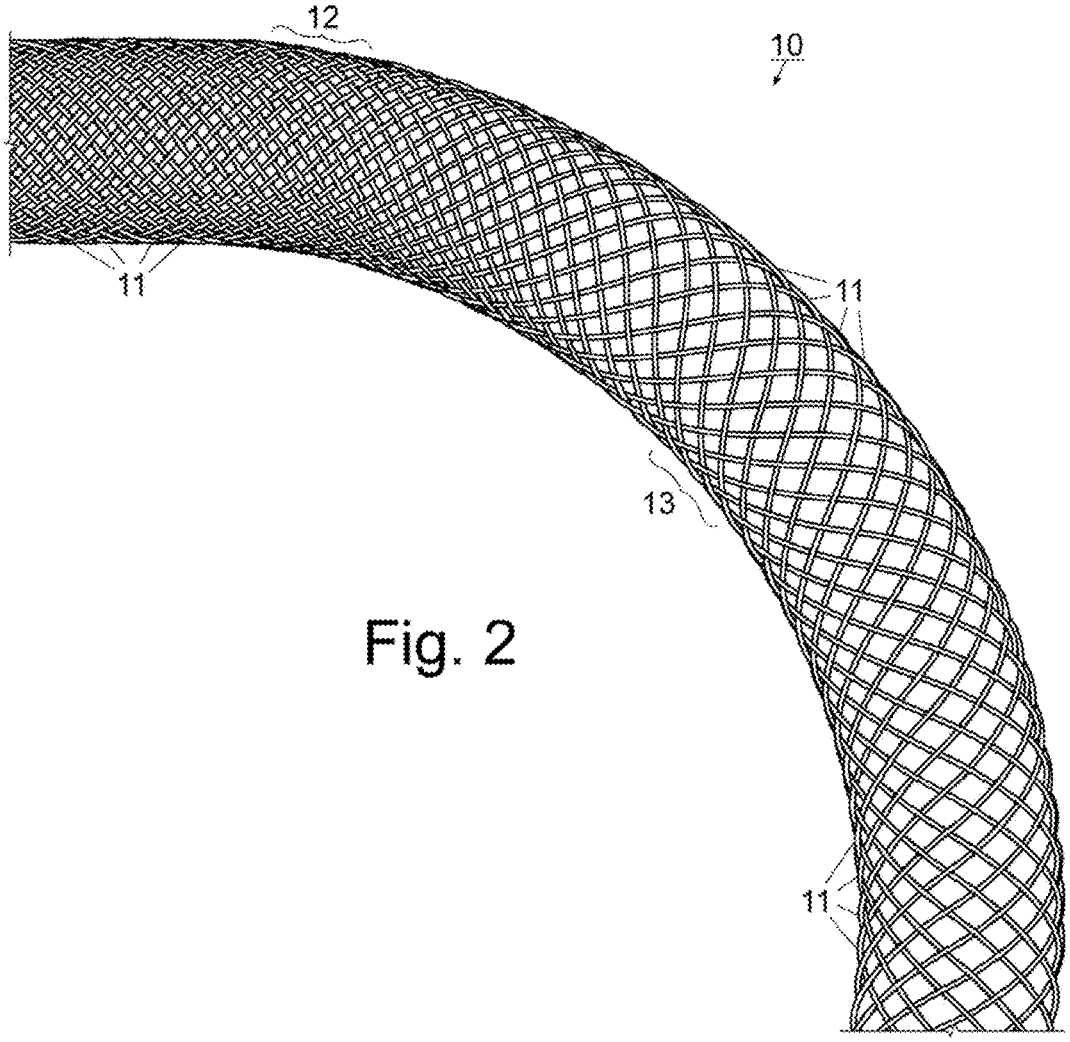

For a better understanding of the invention and its operation, turning now to the drawings, FIGS. 1 and 2 demonstrate elevated plan views of preferred open structure composite member 10. As presented herein, composite member 10 is presented as a cylindrical member deployed as a spring, but it should be understood that the intended use of any composite member disclosed herein should not be construed as a limitation. Further, the figures as drafted present cylindrical embodiments of the various composite members disclosed herein, with a single side represented without the opposing side demonstrated for the sake of visual clarity, but it should be understood that other shapes of composite member are contemplated within the scope of this disclosure. As shown in FIG. 1, composite member 10 is preferably formed from a plurality of yarns 11, referred to in reference to FIGS. 1-2 as "helical" yarns. The preferred embodiment of yarn 11 is defined by a high number (i.e. greater than 20,000 and preferably between 50,000-100,000) carbon filaments axially aligned and positioned within a jacket, as described by U.S. Pat. No. 8,859,088, entitled "Minimal Weight Composites Using Open Structure", U.S. Patent Publication No. 2013/0302604, entitled "Robust Pre-Impregnated Yarn for Manufacturing Textile Composites", and U.S. Patent Publication No. 2015/0056449, entitled "Minimal Weight Composites Using Open Structure". The preferred embodiment of yarn 11 includes filaments, jackets, or both that have been pre-impregnated with an adhesive resin matrix, for example epoxy, vinyl ester, or other polymeric derivatives. The structural spring represented in FIGS. 1 and 2 is achieved by braiding two yarns 11 in the opposite pitch direction about a cylindrical or polygonal mandrel (not shown, but typically tapered) with a conventional braiding machine, such as a Maypole braiding machine (not shown), in a biaxial braiding pattern. Yarns 11 preferably define a braid angle from fifty to one hundred degrees (50°-100°) under torsion and at a failure torque of less than twenty (20) inch ounces for an inch length, indicating that the resulting structure is easily deformed in torsion. This indicates that the resulting structure, for example composite member 10, defines a very low spring constant but possesses excellent multi-directional stiffness.

Preferred composite member 10 enjoys structural superiority over the prior art in part due to a surprising compression stiffness imparted between the braided yarns 11, even without bonding the crossover points of yarns 11 as is taught in the prior art, and obvious solution to impart added rigidity and strength to prior art structures. As used herein, the term "bonded"; "bonding", and other "bond" derivatives refers to the substantial attachment of two or more proximal yarns 11 as they pass over or under one another in combination with the resin matrix as described. Composite member 10 also enjoys improved bending characteristics by virtue of the crossover points not being bound. The unbound, braided configuration produces a much lighter weight construction than a conventional coiled spring, all while unexpectedly producing similar or identical spring constant and comparable range of travel (up to 75% reduction in unrestrained spring length). The braided nature of composite member 10 also defines exceptional and surprising torsional stiffness and bending stiffness for its weight compared to helical springs because bending and torsion create predominantly axial loads in the individual composite elements.

Once yarns 11 are braided, they are laid on the mandrel and spaced widely relative to the yarn spacing typical of a structural component. In the preferred embodiment, yarns 11 define a coverage factor (i.e. the degree of "openness" or exposure between respective yarns) of at least fifty percent (50%), and more preferably of at least seventy-five percent (75%). Yarns 11 may be slightly cured to preserve their orientation and interwoven geometry, but great care is exercised in seeking to limit, and preferably avoid bonding between yarns 11 at any crossover point. The resulting structure may be described as a composite tubular woven lattice. If curing does take place, the resulting composite structure is removed from the mandrel, and any inadvertent crossover point bonding is broken, ensuring that composite structure 10 enjoys the greatest degree of spring flexibility with respect to compression, tension, torsion, and bending. A structure such as composite structure 10 may define unusual and directional properties. For example, composite structure 10 has been shown to exhibit a high resistance to compression relative to a low resistance to tension. When compressed, this compression stiffness increases with increases in length reduction, even prior to contact between the helical elements as is often necessary for conventional coil springs. The difference is particularly stark when viewed from the perspective of resistance to deformation (i.e. high spring constant) as a function of weight, with composite structure 10 having a much lower weight than that of the comparable conventional coil spring. FIG. 2 illustrates this deformability, as composite member 10 may be deformed into any number of desired shapes or orientations that could not otherwise be made on, or even more likely not removed from, a conventional mandrel. As will be described in further detail below, after composite structure 10 is removed from the mandrel and the final shape or orientation is achieved, bonding may take place at the crossover points with a resin that may vary from low (pliable and elastomeric) to high resistance (stiff as that of the original resin infused in yarns 11 such as epoxy, vinyl esters, polyurethane, bismalemide, or other resin materials as are known in the art).

FIGS. 1 and 2 show composite member 10 as defining yarns 11 braided with a variable pitch angle along the longitudinal length of composite member 10, producing helical structures that alters from high coverage area 12 to low coverage area 13 (i.e. tight spacing between the coils interspersed with wider spacing) which more greatly permit the flexible nature of composite member 10 described above (see FIG. 2). An alternate embodiment of composite structure 10 may include yarns 11 similar in all respect as described but with a uniform pitch angle, producing a repeatable braiding pattern and coverage ratio along the longitudinal length of composite structure 10. Such an orientation may include desirable structural or functional characteristics different than those defined by the variable pitch angle embodiment, but nonetheless should be construed as within the scope of the present invention. Additionally, or in the alternative, it is envisioned that sections of open structure composite member 10 may be interspersed with sections of rigid composites to provide for moderate shaft flexibility or to compensate for misalignment between structural elements.

Figure 3:
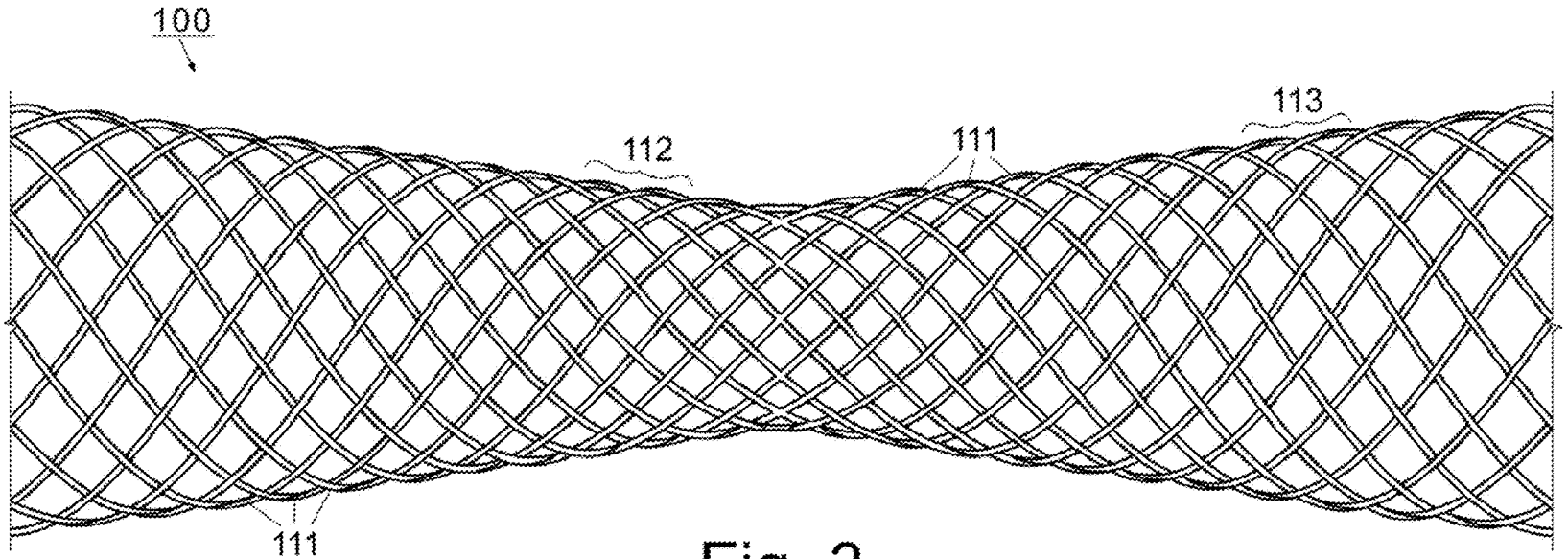
FIG. 3 depicts an elevated plan view of an alternate embodiment of an open architecture composite member, FIG. 4 demonstrates an elevated plan view of an alternate embodiment of an open architecture composite member.

FIG. 3 presents another alternate embodiment of composite structure 100, whereby yarns 111, similar in all respects to yarns 11 as described above, are deployed in substantially the same manner as described to produce composite structure 100 as structure 10. As should be discerned unlike composite structure 10, composite structure 100 defines a constant helix angle with a variable diameter component, producing composite structure 100 which defines narrowing section 112, then widening section 113 in a conical or pyramidal structure. This type of configuration would be impossible to reproducibly braid on a conventional braiding machine, for at least the reason that the associated mandrel could not accommodate the resulting geometry. However, by braiding the structure in the manner disclosed herein, and later curing the crossover points for additional structural integrity as needed, entirely new structural geometries may be achieved that previously have been considered improbable or impractical to manufacture.

Figure 4:
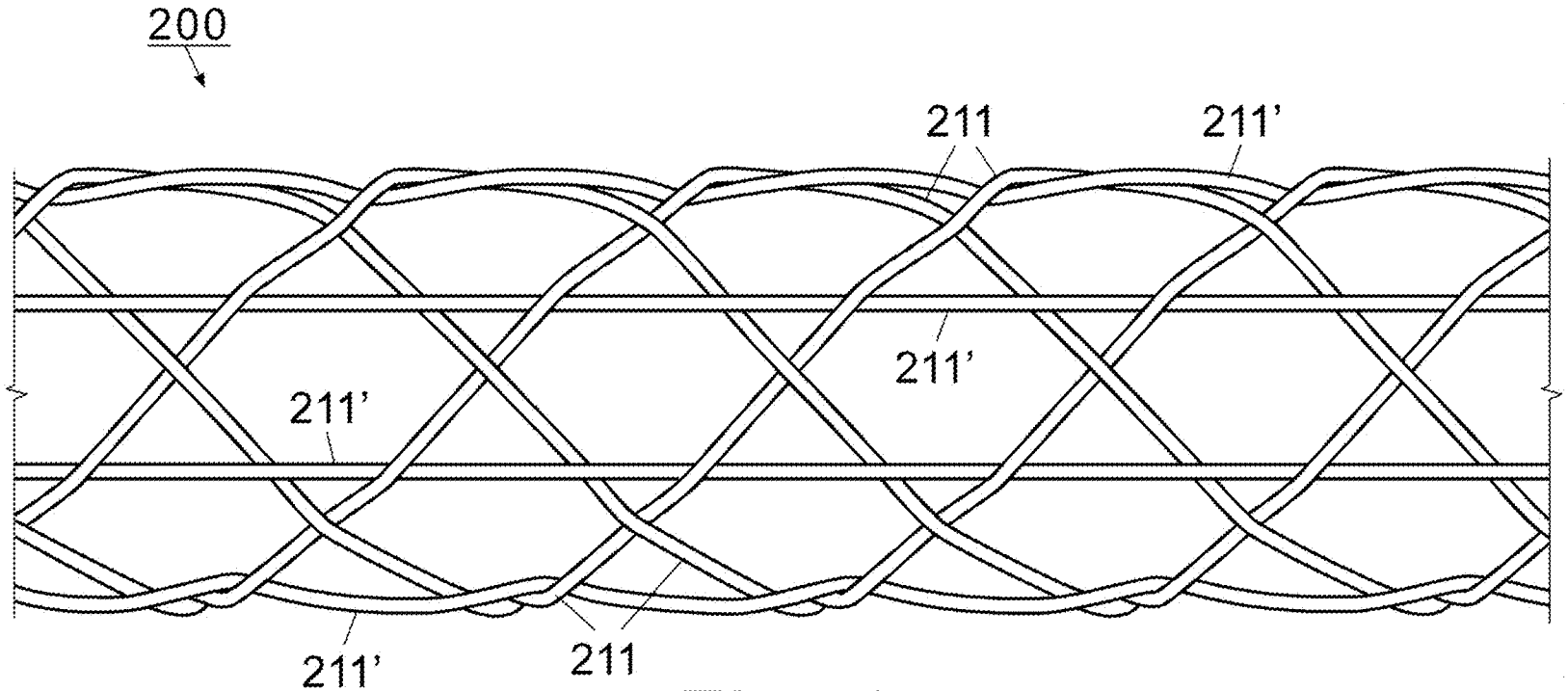
Figure 5:
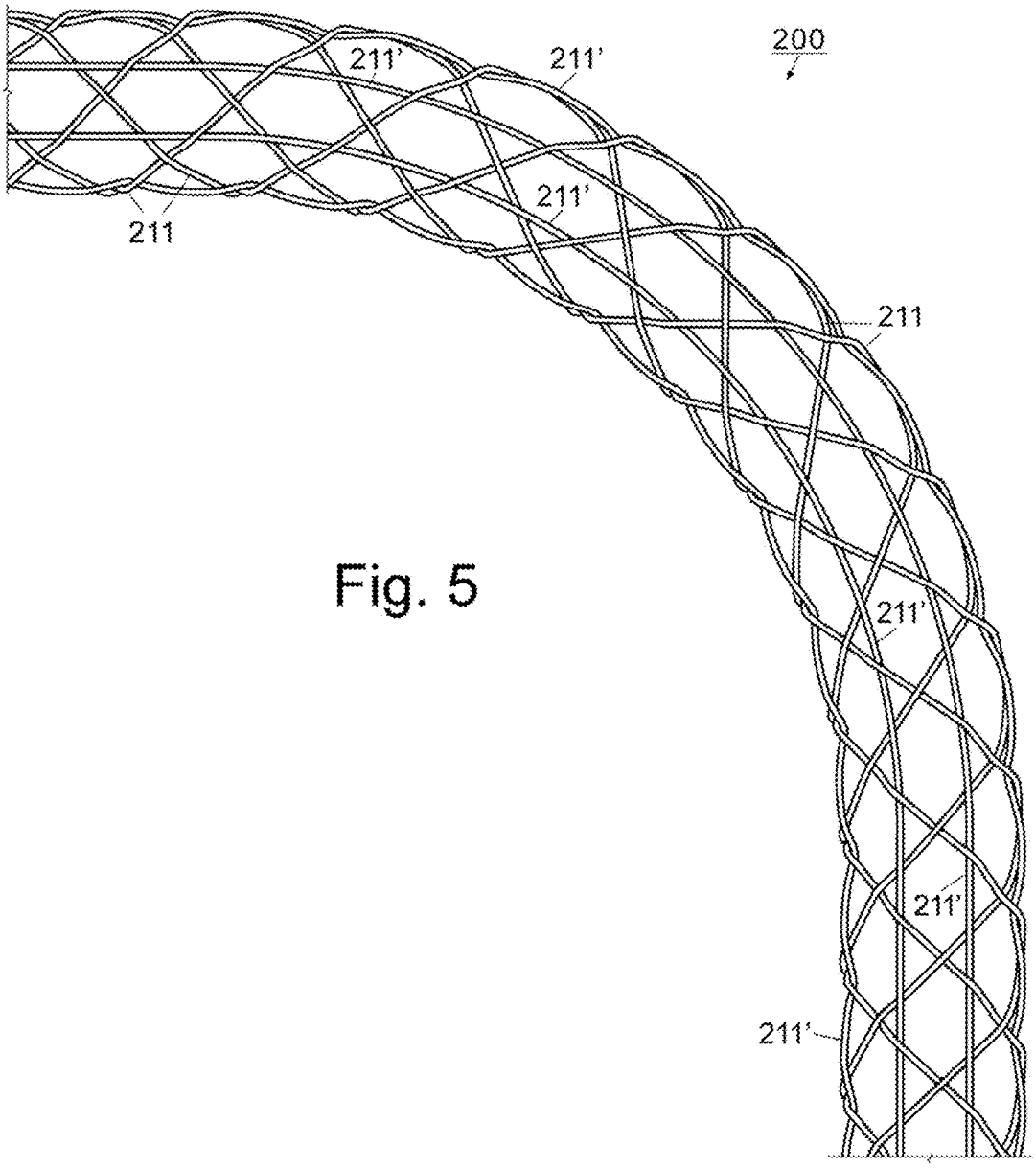
FIG. 5 illustrates an elevated plan view of the member of FIG. 4 after longitudinal contortion.

FIGS. 4 and 5 show elevated plan views of an alternate embodiment of composite structure 200, braided with yarns 211 that are similar in all respects to yarns 11 as described above. As shown, unlike composite structures 10 and 100, composite structure 200 is formed via a true triaxial braiding pattern. This pattern (see U.S. Pat. No. 5,899,134, incorporated by reference in its entirety herein), preferably includes axial yarns 211' laid in the axial direction of composite structure 200 which bestows upon composite structure 200 surprising structural, compression, and bending advantages not found in the prior art.

A method of producing an open architecture, fiber-reinforced composite formed from large (i.e. high filament number) threads pre-impregnated with resin, formed into yarns, and braided without bonded crossover points into a composite member is also disclosed. A plurality of yarns 11, defined by a high number (i.e. greater than 20,000 preferably at least 25,000, and more preferably between 50,000-100,000 but intended herein to be limited only by the ability to braid such yarns) of carbon filaments axially aligned and positioned within a jacket, are loaded onto a braiding machine such as a Maypole braiding machine. The yarns 11 are braided about a mandrel into a tubular woven lattice defining a biaxial braiding pattern defining a uniform pitch angle extending along the longitudinal length of the composite member. Alternatively, yarns 11 are braided about a mandrel into a tubular woven lattice defining a biaxial braiding pattern defining a variable pitch angle extending along the longitudinal length of the composite member. Alternatively, yarns 11 are braided about a mandrel into a tubular woven lattice defining a triaxial braiding pattern defining either a uniform or variable pitch angle extending along the longitudinal length of the composite member. In each case, the yarns 11 are spaced widely on the mandrel relative to the yarn spacing typical of a woven structural component, and the yarns may be cured to preserve their orientation and interwoven geometry, but great care is exercised in seeking to limit, and preferably avoid bonding between yarns 11 at any crossover point. In the preferred embodiment of the method, yarns 11 define a coverage factor (i.e. the degree of "openness" or exposure between respective yarns) of at least fifty percent (50%), and more preferably of at least seventy-five percent (75%).

The composite member is then removed from the mandrel and utilized as a spring, exhibiting superior compression, torsional, bending, and tension metrics compared to coil springs formed from metal materials. Any inadvertent bonding at crossover points may be broken upon removal to maintain desired flexion capabilities. Alternatively, the composite member may be cured to structurally reinforce the resulting composite member before deploying it as a spring. Alternatively, the composite member may be urged, bent, or otherwise manipulated to assume any number of shapes as desired, shapes that would not otherwise be possible with a mandrel defining a uniform or tapered exterior. An embodiment of one or more composite members as described above may include an exterior sleeve (not shown) formed from a pre-impregnated material as an added structural support without significant weight increase. The resulting composite member, regardless of exterior reinforcement, may then be cured to structurally reinforce the resulting composite member before deploying it as a spring.

Example 1

A cylindrical open composite structure made on a Maypole braiding machine from large, jacketed prepreg yarns similar to those in U.S. Patent Publication No. 2013/0302604 consists of two opposing sets of helical yarns interwoven in a biaxial pattern to produce an open lattice structure braided spring, in which the yarns were not bonded together at the crossover after curing. The braided structure is restricted in its compression by the necessity for the yarns to bend to accommodate the weave structure during compression. The resulting spring has a spring constant that is larger than the sum of the same number of helical springs made from the same yarn material at the same pitch and arranged in parallel. Unlike a helical spring, the woven structure relies on deformation modes other than torsion or compression of the spring element for development of the spring stiffness.

Example 2

A cylindrical open composite structure made on a May-pole braiding machine from large jacketed prepreg yarns similar to those in Example 1 consists of two opposing sets of helicals interwoven in a biaxial pattern to produce a braided spring, in which the yarns are slightly bonded together at the crossovers after curing. The lightly bonded structure may be compressed axially to break the bonds at yarn crossovers producing a braid equivalent in stiffness properties to the spring in Example 1.

Example 3

The spring of Example 1 was bent into a circular shape of twenty-six (26) inches inner diameter and one end threaded inside the other end to make a circular spring which was bonded at the overlapped ends with epoxy, then sprayed with a plasticized PVC and installed on a tire rim to produce a tire in the form of a spring which is suitable for use on a sandy granular surface, like a desert, a beach, a snowy surface, or on the surface of the moon.

Example 4

A tube was braided with three sets of large prepreg yarns (two helical sets and one set of axial yarns) and cured but without bonding yarn crossovers. The structure was limited in axial compression in the axial direction by the axial cured composite yarns; however, the structure was flexible and spring-like in bending and torsion modes. Such structures have potential as a drive shaft with some limited flexibility. A shaft of interspersed rigid and flexible sections is also envisioned.

Example 5

A braided open composite structure with two sets of helical yarns was produced using a process similar to Example 2 except that the braided tubular shape is rectangular with rounded corners. A spring with broken joints is formed into a path that may bend to change direction or to pass around obstacles that cause the path to deviate from a straight line. The braided open structure is suitable for a cable tray that is bent into a non-linear shape to follow a sinuous path after the joints are broken. Later the joints may be cured with a glue-like epoxy, with the braid now set and locked into the shape of the path. Alternatively, the cable tray may be mobile to facilitate actuation as is known in the art, for example on industrial automation machinery with cable management to supply a cutting head for a CNC (Computer Numerical Control) router. In either application, cables can now feed into the cable tray.

Example 6

A braided open structure spring was produced similar to Example 4, except that the axial yarns are not prepreg and do not form fiber-reinforced composite elements after curing. The axials in this case are unimpregnated textile yarns of the high performance fiber such as liquid crystal polymer (LCP), aramid, metal wire, or UHMPE (Ultra-high-molecular-weight polyethylene). The non-impregnated LCP yarns provide stability in bending deformation and in tension, but allow the structure to compress as those from Example 1 and 2. This example should not be considered to limit the type of yarn used for axials members in the respective structures. Other high perfoiniance fibers, including metal or synthetic embodiments, are envisioned as are high compliance fibers, for example elastomers.

Example 7

A cylindrical open composite structure formed and cured as described above (i.e. with unbonded crossover points), and covered, encased, or otherwise inserted into a sleeve formed from a resin pre-impregnated material (or alternatively, a braided sleeve that is later coated or impregnated with resin). The sleeved structure is then bent into any desired shape and the entire assembly is recurred to produce a stiffened, rib-shaped tubular structure.

The illustrations and examples provided herein are for explanatory purposes and are not intended to limit the scope of the appended claims.

We claim:

1. An open structure composite member comprised of a plurality of jacketed yarns each comprised of one or more tows defining a core formed from at least twenty thousand (20,000) axially aligned filaments packed within a jacket, whereby the plurality of jacketed yarns are combined to form an open structure composite member without bonding the crossover points of the combined yarns, whereby the open structure composite member has a first value defined by a compressive stiffness of the open structure composite member and a second value defined by a bending stiffness of the open structure composite member, and whereby the first value is greater than the second value, indicating that the open structure composite member is deformed in torsion or bending.

2. The composite member of claim 1 whereby the jacket is pre-impregnated with an adhesive resin matrix.

3. The open structure composite member of claim 1 whereby the one or more tows are pre-impregnated with an adhesive resin matrix.

4. The open structure composite member of claim 1 whereby the open structure defines a uniform pitch angle between fifty to one hundred degrees (50°-100°).

5. The open structure composite member of claim 1 whereby the open structure defines a variable pitch angle.

6. The open structure composite member of claim 1 whereby the open structure defines a biaxial braid.

7. The open structure composite member of claim 1 whereby the open structure defines a triaxial braid.

8. The open structure composite member of claim 1 whereby the open structure defines a true triaxial braid.

9. A method of forming an open structure composite member comprising:

providing a plurality of jacketed yarns each comprised of a plurality of tows pre-impregnated with resin matrix and that define a core formed from at least twenty thousand (20,000) axially aligned filaments packed within a jacket, combining the plurality of jacketed yarns on a braiding machine, and forming an open structure composite member with the jacketed yarns without bonding the crossover points of the jacketed yarns, whereby the open structure composite member has a first value defined by a compressive stiffness of the open structure composite member and a second value defined by a bending stiffness of the open structure composite member, and whereby the first value is greater than the second value, indicating that the open structure composite member is deformed in torsion or bending.

10. The method of claim 9 whereby the step of combining the plurality of jacketed yarns further comprises braiding the plurality of jacketed yarns about a mandrel without bonding the crossovers of the jacketed yarns.

11. The method of claim 10 whereby the step of braiding the plurality of jacketed yarns further comprises braiding the plurality of jacketed yarns in a biaxial braiding pattern.

12. The method of claim 11 further comprising the step of manipulating the open structure composite member into a shape other than that defined by the mandrel.

13. The method of claim 10 whereby the step of braiding the plurality of jacketed yarns further comprises braiding the plurality of jacketed yarns in a triaxial braiding pattern.

14. The method of claim 13 further comprising the step of manipulating the open structure composite member into a shape other than that defined by the mandrel.

15. The method of claim 11 whereby the step of braiding the plurality of jacketed yarns in a biaxial braiding pattern further comprises defining a uniform pitch angle extending along the longitudinal length of the open structure composite member.

16. The method of claim 11 whereby the step of braiding the plurality of jacketed yarns in a biaxial braiding pattern further comprises defining a varying pitch angle extending along the longitudinal length of the open structure composite member.

17. A method of forming an open structure composite member comprising:

providing a plurality of jacketed yarns each comprised of a plurality of tows pre-impregnated with resin matrix and that define a core formed from at least twenty thousand (20,000) axially aligned filaments packed within a jacket, combining the plurality of jacketed yarns on a braiding machine, breaking any bonded crossover points, and forming an open structure composite member with the jacketed yarns without bonding the crossover points of the jacketed yarns, whereby the open structure composite member has a first value defined by a compressive stiffness of the open structure composite member and a second value defined by a bending stiffness of the open structure composite member, and whereby the first value is greater than the second value, indicating that the open structure composite member is deformed in torsion and bending.

18. The method of claim 17 further comprising the steps of:

braiding the plurality of jacketed yarns about a mandrel, and manipulating the open structure composite member into a shape other than that defined by the mandrel.

* * * * *